US008635800B2

(12) United States Patent
Glimpse et al.

(10) Patent No.: US 8,635,800 B2
(45) Date of Patent: Jan. 28, 2014

(54) GUN SIGHT

(71) Applicant: Trijicon, Inc., Wixom, MI (US)

(72) Inventors: Bryan R. Glimpse, Trenton, MI (US); Robert W. Condra, New Hudson, MI (US); Joshua Lee Varner, Commerce, MI (US); Joseph R. Adkins, Howell, MI (US)

(73) Assignee: Trijicon, Inc., Wixom, MI (US)

( * ) Notice: Subject to any disclaimer, the term of this patent is extended or adjusted under 35 U.S.C. 154(b) by 0 days.

(21) Appl. No.: 13/793,424

(22) Filed: Mar. 11, 2013

(65) Prior Publication Data

US 2013/0185983 A1 Jul. 25, 2013

Related U.S. Application Data

(62) Division of application No. 13/222,740, filed on Aug. 31, 2011.

(60) Provisional application No. 61/422,728, filed on Dec. 14, 2010.

(51) Int. Cl.
*F41G 1/00* (2006.01)

(52) U.S. Cl.
USPC ..... 42/132; 42/131

(58) Field of Classification Search
USPC ..... 42/131, 132
See application file for complete search history.

(56) References Cited

U.S. PATENT DOCUMENTS

| | | | | |
|---|---|---|---|---|
| 1,363,553 | A | 12/1920 | Barringer | |
| 1,922,302 | A | 8/1933 | King | |
| 2,488,541 | A | 11/1949 | Holme | |
| 2,706,335 | A | 4/1955 | Munsey | |
| 2,931,101 | A | 4/1960 | Hermann | |
| 3,184,851 | A | 5/1965 | Simmons | |
| 3,439,970 | A * | 4/1969 | Rickert | 42/131 |

(Continued)

FOREIGN PATENT DOCUMENTS

| | | | |
|---|---|---|---|
| EP | 470016 | A1 | 2/1992 |
| WO | 2010034458 | A1 | 4/2010 |

OTHER PUBLICATIONS http://web.archive.org/web/20060524161152/http://www.10-8performance.com; 10-8 Performance, Duty Ready 1911s; Hilton Yam; May 24, 2008; 2 Pages.

(Continued)

*Primary Examiner* — Samir Abdosh

(74) *Attorney, Agent, or Firm* — Harness, Dickey & Pierce, P.L.C.

(57) ABSTRACT

A sight assembly for a firearm is provided and may include a main body attached to the firearm and a pair of projections defining a first surface opposing a shooter and a second surface formed on an opposite side of the projections than the first surface. The first surface may be formed at an angle relative to a top surface of the firearm such that a bottom portion of the first surface disposed proximate to the top surface of the firearm is farther away from a shooter than a top portion of the first surface. The sight assembly may further include a U-shaped opening disposed between the pair of projections and in communication with a passage defined by the pair of projections, whereby the passage widens along a length of the pair of projections in a direction extending from the first surface to the second surface.

16 Claims, 12 Drawing Sheets

(56) References Cited

U.S. PATENT DOCUMENTS

| | | | | |
|---|---|---|---|---|
| 3,641,676 | A | 2/1972 | Knutsen et al. | |
| 3,698,091 | A | 10/1972 | Merrill et al. | |
| 3,700,339 | A | 10/1972 | Steck, III | |
| 3,777,380 | A | 12/1973 | Theodore | |
| 3,916,530 | A | 11/1975 | Tellie | |
| 4,015,354 | A | 4/1977 | Brouthers | |
| D247,856 | S | 5/1978 | Korzeniewski | |
| 4,366,625 | A | 1/1983 | Gehmann | |
| D273,217 | S | 3/1984 | Swenson | |
| D296,227 | S | 6/1988 | Novak | |
| D301,512 | S | 6/1989 | Novak | |
| D305,146 | S | 12/1989 | Novak | |
| D305,561 | S | 1/1990 | Novak | |
| D315,776 | S | 3/1991 | Novak | |
| 5,065,519 | A | 11/1991 | Bindon | |
| 5,070,619 | A | 12/1991 | Santiago | |
| 5,103,567 | A | 4/1992 | Loving | |
| D352,087 | S | 11/1994 | Stevens et al. | |
| 5,359,800 | A | 11/1994 | Fisher et al. | |
| 5,426,882 | A | 6/1995 | Dornaus | |
| 5,442,861 | A | 8/1995 | Lorocco | |
| D363,334 | S | 10/1995 | De Oliveira Masina | |
| 5,471,777 | A | 12/1995 | McDonald | |
| RE35,347 | E | 10/1996 | Bindon | |
| 5,638,604 | A | 6/1997 | Lorocco | |
| D382,038 | S | 8/1997 | Nigh | |
| D387,844 | S | 12/1997 | Emerson | |
| 5,735,070 | A | 4/1998 | Vasquez et al. | |
| D399,291 | S | 10/1998 | Emerson | |
| D399,292 | S | 10/1998 | Emerson | |
| 5,836,100 | A | 11/1998 | Stover | |
| D403,734 | S | 1/1999 | Kay | |
| 5,862,618 | A | 1/1999 | Brown | |
| D406,630 | S | 3/1999 | Emerson | |
| 5,878,503 | A | 3/1999 | Howe et al. | |
| 5,878,521 | A | 3/1999 | Warnock | |
| 5,887,352 | A | 3/1999 | Kim | |
| 5,956,854 | A | 9/1999 | Lorocco | |
| 5,965,854 | A | 10/1999 | Umemura | |
| 6,014,830 | A | 1/2000 | Brown et al. | |
| 6,016,608 | A | 1/2000 | Lorocco | |
| 6,035,539 | A | 3/2000 | Hollenbach et al. | |
| 6,058,615 | A | 5/2000 | Uhlmann et al. | |
| 6,058,616 | A | 5/2000 | Bubits | |
| 6,070,355 | A | 6/2000 | Day | |
| 6,085,427 | A | 7/2000 | Persson | |
| 6,122,833 | A | 9/2000 | Lorocco | |
| D435,625 | S | 12/2000 | Ling, Jr. | |
| D436,393 | S | 1/2001 | Ling, Jr. | |
| 6,216,351 | B1 * | 4/2001 | Flubacher et al. | 42/145 |
| 6,216,352 | B1 | 4/2001 | Lorocco | |
| D443,016 | S | 5/2001 | Nigh | |
| 6,233,836 | B1 | 5/2001 | Uhlmann et al. | |
| D447,205 | S | 8/2001 | Keng | |
| 6,279,976 | B1 | 8/2001 | Ball | |
| 6,360,471 | B1 | 3/2002 | Stein | |
| 6,360,472 | B1 | 3/2002 | Lorocco | |
| 6,367,189 | B1 | 4/2002 | Clay | |
| 6,421,946 | B1 | 7/2002 | LoRocco | |
| 6,446,377 | B1 | 9/2002 | Hollenbach et al. | |
| 6,571,504 | B2 | 6/2003 | Carlson | |
| 6,622,413 | B1 | 9/2003 | Bickett | |
| 6,640,482 | B2 | 11/2003 | Carlson | |
| 6,711,846 | B1 | 3/2004 | Nasef | |
| D492,747 | S | 7/2004 | LoRocco | |
| 6,769,210 | B2 | 8/2004 | Bubits | |
| 6,834,457 | B1 | 12/2004 | Warren | |
| 6,860,056 | B2 | 3/2005 | Howe | |
| D512,118 | S | 11/2005 | Warren | |
| D512,760 | S | 12/2005 | Warren | |
| D515,170 | S | 2/2006 | Price | |
| D520,099 | S | 5/2006 | Warren | |
| D520,592 | S | 5/2006 | Warren | |
| D521,101 | S | 5/2006 | Warren | |
| D521,591 | S | 5/2006 | Warren | |
| D526,695 | S | 8/2006 | Warren | |
| D527,068 | S | 8/2006 | Warren | |
| D531,693 | S | 11/2006 | Warren et al. | |
| D533,616 | S | 12/2006 | Warren | |
| D533,617 | S | 12/2006 | Warren | |
| D534,986 | S | 1/2007 | Warren et al. | |
| D541,897 | S | 5/2007 | Warren et al. | |
| D546,915 | S | 7/2007 | Price | |
| 7,287,351 | B1 | 10/2007 | Warren | |
| D560,744 | S | 1/2008 | Warren et al. | |
| D565,144 | S | 3/2008 | Price | |
| 7,451,566 | B1 | 11/2008 | Price | |
| 7,458,180 | B2 * | 12/2008 | Liang | 42/123 |
| 7,562,486 | B2 * | 7/2009 | LoRocco | 42/132 |
| 7,565,762 | B2 | 7/2009 | Lackey | |
| 7,627,976 | B1 * | 12/2009 | Olson | 42/145 |
| D611,112 | S | 3/2010 | Kay | |
| 7,676,137 | B2 | 3/2010 | Schick et al. | |
| 7,886,475 | B2 | 2/2011 | Dubois | |
| 7,905,044 | B2 | 3/2011 | Clouser | |
| 7,908,783 | B2 | 3/2011 | Howe et al. | |
| 8,037,634 | B2 | 10/2011 | Price | |
| 8,132,352 | B2 | 3/2012 | Lippard | |
| 8,189,967 | B1 * | 5/2012 | Olson | 385/12 |
| 8,230,637 | B2 * | 7/2012 | Lamb | 42/145 |
| 8,261,481 | B1 | 9/2012 | Shebaro | |
| 8,296,990 | B2 | 10/2012 | Zukowski et al. | |
| 2002/0157298 | A1 | 10/2002 | Carlson | |
| 2002/0166278 | A1 | 11/2002 | Carlson | |
| 2004/0025398 | A1 | 2/2004 | Howe | |
| 2006/0123687 | A1 | 6/2006 | Howe et al. | |
| 2006/0207157 | A1 | 9/2006 | Keng | |
| 2007/0240354 | A1 | 10/2007 | Warren | |
| 2008/0092424 | A1 * | 4/2008 | Keng | 42/137 |
| 2009/0013581 | A1 * | 1/2009 | LoRocco | 42/132 |
| 2009/0126251 | A1 | 5/2009 | Howe et al. | |
| 2010/0088944 | A1 * | 4/2010 | Callihan | 42/145 |
| 2010/0170138 | A1 | 7/2010 | Zukowski | |
| 2011/0067286 | A1 | 3/2011 | Price | |
| 2011/0107650 | A1 | 5/2011 | Howe et al. | |
| 2011/0197491 | A1 | 8/2011 | McCann | |
| 2011/0225867 | A1 * | 9/2011 | Moore et al. | 42/114 |
| 2011/0314721 | A1 | 12/2011 | Lamb | |
| 2012/0144721 | A1 * | 6/2012 | Glimpse et al. | 42/132 |
| 2012/0151817 | A1 | 6/2012 | Howe et al. | |
| 2012/0198750 | A1 | 8/2012 | Mansfield | |
| 2013/0061511 | A1 | 3/2013 | Strayer | |
| 2013/0180156 | A1 | 7/2013 | Shebaro | |

OTHER PUBLICATIONS

Non-Final Office Action in U.S. Appl. No. 131222,740, mailed Mar. 27, 2013.

Patent Examination Report No. 1 regarding Patent Application No. 2011253529, dated Mar. 21, 2013.

Non-Final Office Action in U.S. Appl. No. 13/285,537, mailed Apr. 15, 2013.

Non-Final Office Action in U.S. Appl. No. 13/793,505, mailed May 9, 2013.

Final Office Action in U.S. Appl. No. 13/222,740, mailed Jun. 25, 2013.

Patent Examination Report No. 2 regarding Patent Application No. 2011253529, dated Aug. 5, 2013.

Final Office Action in U.S. Appl. No. 13/285,537, mailed Jul. 25, 2013.

* cited by examiner

GUN SIGHT

CROSS-REFERENCE TO RELATED APPLICATION

This application is a divisional of U.S. patent application Ser. No. 13/222,740 filed on Aug. 31, 2011, which claims the benefit of U.S. Provisional Application No. 61/422,728 filed on Dec. 14, 2010. The disclosures of the above applications are herein incorporated by reference in their entirety.

FIELD

The present disclosure relates to a sighting system and more particularly to a sighting system incorporating a pair of sight assemblies.

BACKGROUND

This section provides background information related to the present disclosure which is not necessarily prior art.

Aiming sights for weapons are commonly used to properly align a weapon with a target. When used in conjunction with a small firearm such as a handgun, sighting systems typically include at least one fixed aiming point disposed at a distal end of a barrel of the firearm. The aiming point may be used by a shooter to align the barrel of the firearm with a target to increase the likelihood that a projectile fired from the firearm will impact a target at a desired location.

Prior-art sighting systems are not limited to a single, fixed aiming point disposed at a distal end of a barrel of a firearm. Rather, conventional sighting systems for use in conjunction with small firearms may include a second sight mechanism disposed proximate to a rear portion of the firearm to aid a shooter in properly aligning the firearm relative to a target. For example, a sighting system may include a rear sight disposed proximate to the shooter and a forward sight disposed proximate to a distal end of a barrel of the firearm. The rear sight may be used in conjunction with the front sight to properly align the elevation and/or windage of the firearm relative to a target. Such systems incorporating a rear sight and a front sight may include a front-aiming point associated with the front sight and a pair of rear-aiming points associated with the rear sight. In such a configuration, alignment of the front-aiming point with the rear-aiming points properly aligns the firearm relative to a target.

While prior-art sighting systems adequately aid a shooter in aligning a barrel of a firearm relative to a target by properly aligning a front-aiming point with a pair of rear-aiming points, such prior-art sighting systems do not include features that allow a shooter to quickly differentiate between the front-aiming point and the rear-aiming points to quickly and accurately align the front-aiming point with the rear-aiming points.

SUMMARY

This section provides a general summary of the disclosure, and is not a comprehensive disclosure of its full scope or all of its features.

A sight assembly for a firearm is provided and may include a main body attached to the firearm and a pair of projections defining a first surface opposing a shooter and a second surface formed on an opposite side of the projections than the first surface. The first surface may be formed at an angle relative to a top surface of the firearm such that a bottom portion of the first surface disposed proximate to the top surface of the firearm is farther away from a shooter than a top portion of the first surface. The sight assembly may further include a U-shaped opening disposed between the pair of projections and in communication with a passage defined by the pair of projections, whereby the passage widens along a length of the pair of projections in a direction extending from the first surface to the second surface.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
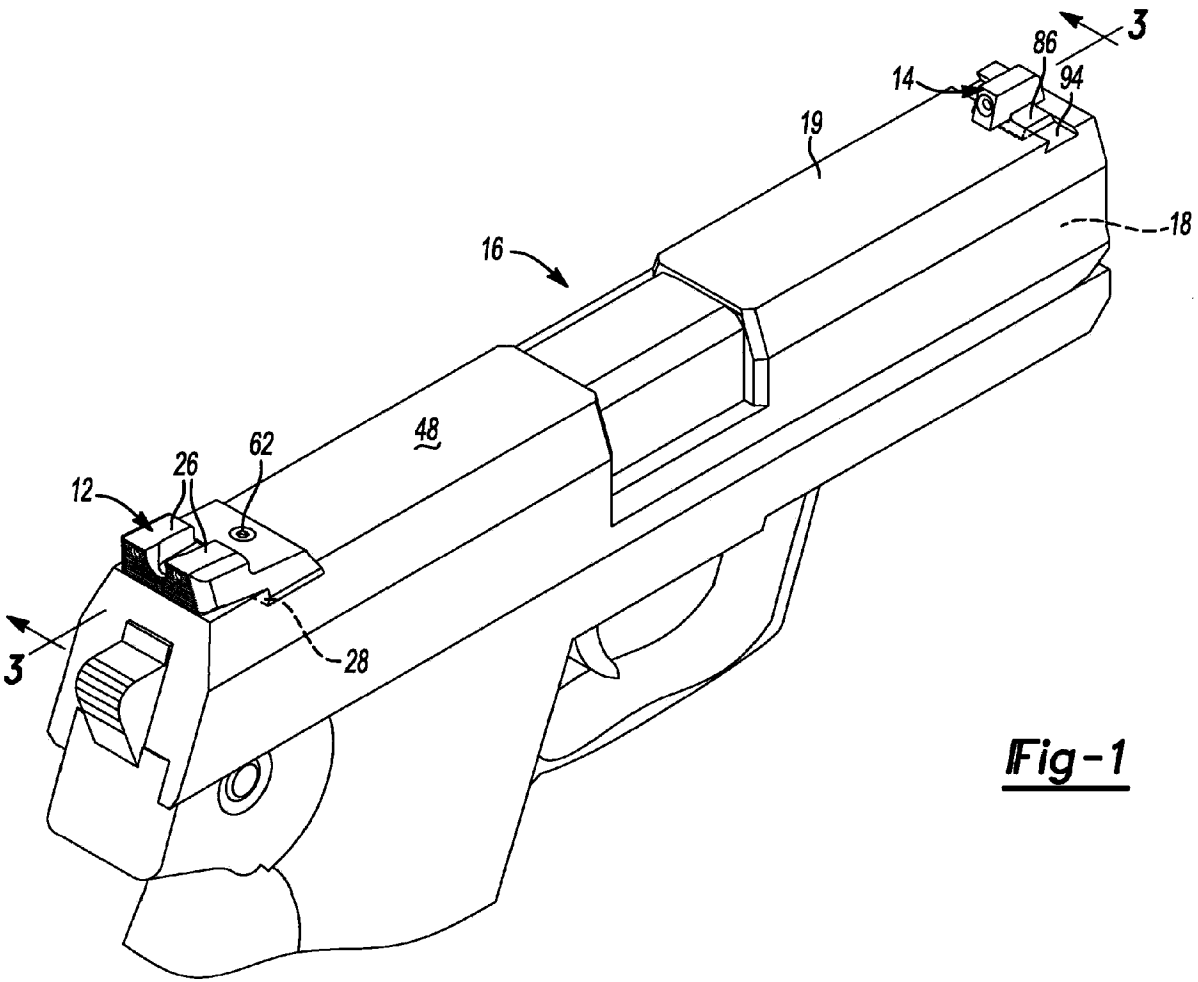
FIG. 1 is a perspective view of a firearm incorporating a sighting system in accordance with the principles of the present disclosure.

Example embodiments will now be described more fully with reference to the accompanying drawings.

With reference to the figures, a sighting system 10 is provided and includes a rear-sight assembly 12 and a front-sight assembly 14. The rear-sight assembly 12 and the front-sight assembly 14 may be attached to a firearm or other weapon 16 to align a barrel 18 of the firearm 16 relative to a target.

Figure 2:
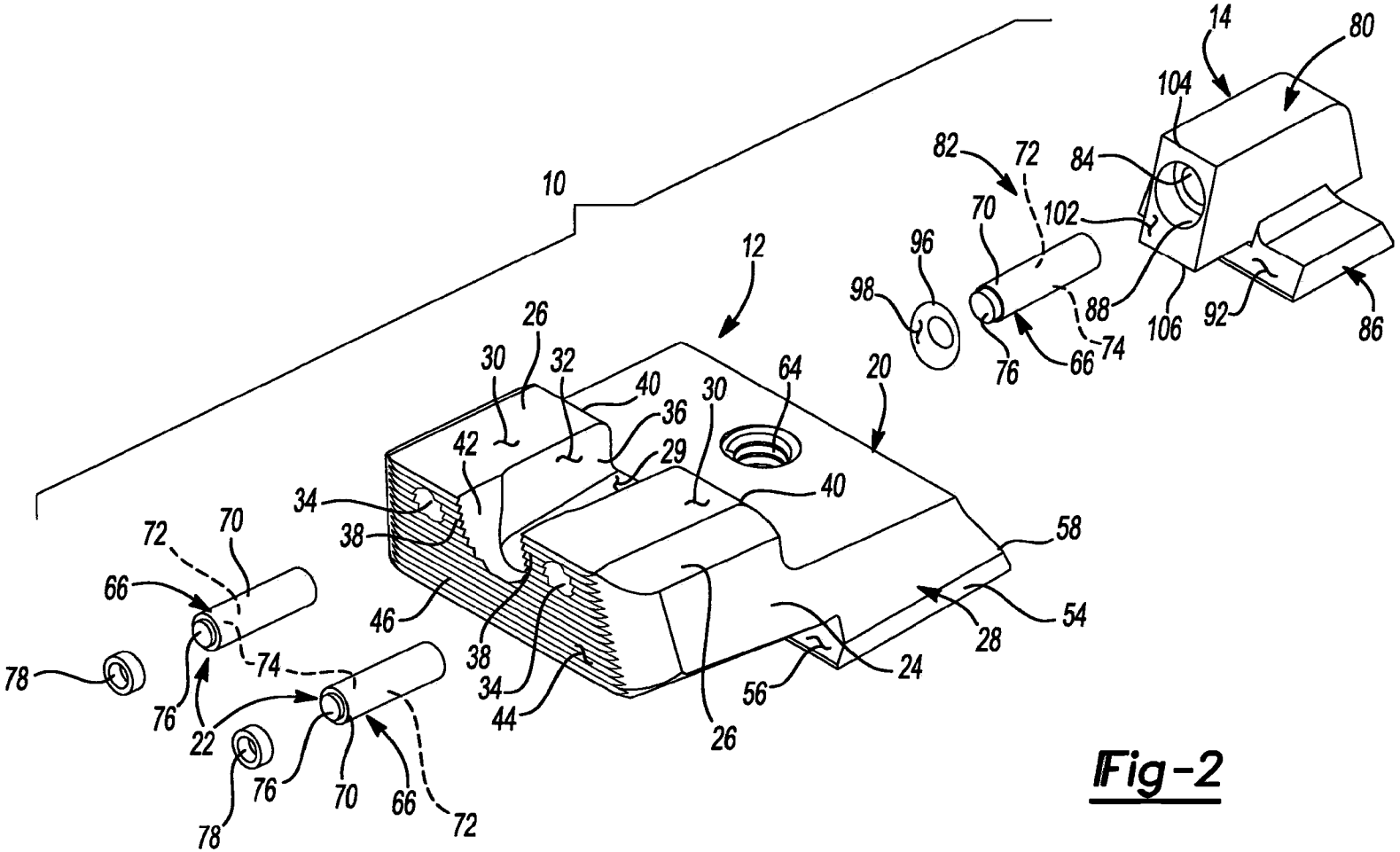
FIG. 2 is an exploded view of the sighting system of FIG. 1.

With particular reference to FIG. 2, the rear-sight assembly 12 may include a housing 20 and an illumination device 22. The housing 20 may include a main body 24 having a pair of projections 26 extending therefrom and an attachment feature 28 for selectively attaching the housing 20 to a slide 19 or top surface 48 of the firearm 16. The projections 26 may each include a top surface 30, opposing side surfaces 32, and a bore 34 at least partially formed therethrough. The projections 26 may extend from the main body 24 and may be spaced apart from one another to define a channel 36 therebetween.

The housing 20 may also include a substantially rear vertical surface 31 flanked by rounded or radiused surfaces 33 and 35. The vertical surface 31 may be substantially perpendicular to a top surface 48 of the firearm 16 and/or to the main body 24 of the housing 20. The substantially vertical surface 31 allows a shooter to manipulate the slide 19 using a single hand by providing a surface (i.e., surface 31) against which a force may be applied to actuate the slide 19. For example, the surface 31 may be positioned adjacent virtually any external surface such as, for example, a door jam, table, or belt (none shown) to allow the shooter to apply a force to the slide 19 via engagement between surface 31 of the rear-sight assembly 12 and the external surface. The substantially vertical surface 31 therefore provides a shooter with the ability to cycle the slide 19 using one hand. The rounded surfaces 33, 35 are provided to prevent inadvertent cycling of the slide 19. For example, the rounded surfaces 33, 35 prevent "snag" when the firearm 16 is holstered.

Figure 4:
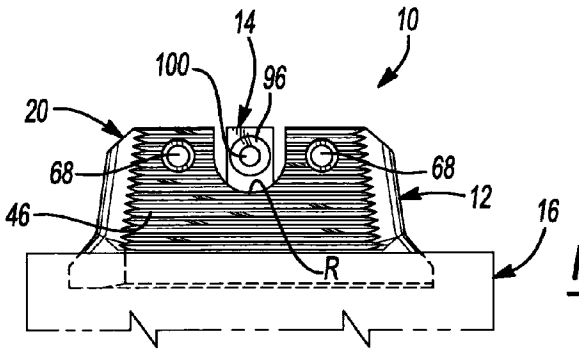
FIG. 4 is a front view of the sighting system of FIG. 1 showing alignment between a rear-sight assembly and a front-sight assembly.

The channel 36 may extend along a length of each projection 26 from a front end 38 of each projection 26 to a rear end 40 of each projection 26 to define the channel 36. In one configuration, the channel 36 may include a substantially U-shaped opening 42 proximate to the front end 38 of each projection 26 having a bottom portion with a radius (R)(FIG. 4). The U-shape 42 may be used in conjunction with the front-sight assembly 14 to properly align the rear-sight assembly 12 relative to the front-sight assembly 14 and, thus, the barrel 18 of the firearm 16 relative to a target. The U-shape 42 is sized to provide sufficient clearance for a shooter to view the front-sight assembly 14 and may include a sufficient width that permits a gap on either side of the front-sight assembly 14 when viewed though the U-shaped opening 42 to permit a shooter to clearly and accurately view the front-sight assembly 14.

Regardless of the particular size of the U-shaped opening 42, the channel 36 may be widened and deepened (i.e., into the main body 24) in a direction toward the front-sight assembly 14 to prevent a "hallway" effect when viewing the front-sight assembly 14 through the U-shaped opening 42. Specifically, widening and deepening the channel 36 in a direction toward the front-sight assembly 14 prevents the shooter from seeing the opposing side surfaces 32 and bottom surface 29 that define the channel 36 when viewing the front-sight assembly 14 through the U-shaped opening 42 and, as a result, provides the shooter with a clear view of the front-sight assembly 14. Because the channel 36 widens and deepens toward the front-sight assembly 14, the distance between the side surfaces 32 increases and the bottom surface 29 extends into the main body 24 further in a direction extending away from the U-shaped opening 42 and toward the front-sight assembly 14.

The front end 38 of each projection 26 may terminate at a common surface 44 of the housing 20, whereby the surface 44 extends substantially across the front end 38 of each projection 26 and joins the projections 26 at an area proximate to the opening of the channel 36 and the U-shaped opening 42. The surface 44 may include a series of serrations 46 and may be formed at an angle (β) (FIG. 3) relative to the top surface 48 of the firearm 16. In one configuration, the angle (β) provides the surface 44 with a back angle such that a top 50 of the front end 38 is positioned closer to a rear portion of the firearm 16 and, therefore, closer to a shooter than is a bottom 52 of the front end 38. Positioning the front end 38 at a back angle (β) relative to the top surface 48 of the firearm 16 in combination with providing the surface 44 of the housing 20 with serrations 46 reduces glare experienced by the shooter when attempting to align the rear-sight assembly 12 with the front-sight assembly 14.

Figure 3:
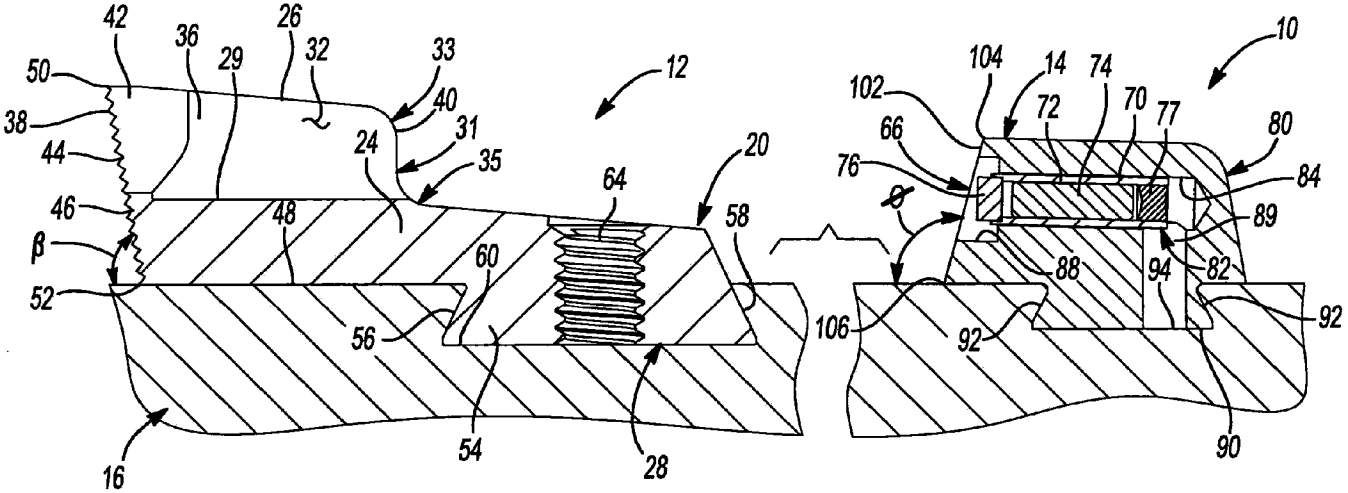
FIG. 3 is a cross-sectional view of the sighting system of FIG. 1 taken along lines 3-3 of FIG. 1.

With particular reference to FIG. 3, the attachment feature 28 extends generally from the main body 24 and may extend from the main body 24 in an opposite direction than do the projections 26. In one configuration, the attachment feature 28 includes a base 54 and a pair of tapered surfaces 56, 58. The base 54—due to the tapered surfaces 56, 58—widens in a direction extending away from the main body 24 and toward the firearm 16. The base 54 may be slidably received within a mating slot 60 formed in the firearm 16 to prevent inadvertent removal of the rear-sight assembly 12 from the firearm 16. Because the base 54 widens as the base 54 extends from the main body 24 and into the firearm 16, the tapered surfaces 56, 58 engage the slot 60 to concurrently prevent inadvertent removal of the housing 20 from the firearm 16 and allow selective removal of the housing 20 from the firearm 16 when a force is applied to the housing 20 in a direction substantially perpendicular to a longitudinal axis of the barrel 18 of the firearm 16. Allowing removal of the housing 20 allows removal of the rear-sight assembly 12 from the firearm 16 to provide a shooter with the ability to use the firearm 16 both with and without the rear-sight assembly 12.

During installation, the rear-sight assembly 12 may be positioned relative to the firearm 16 such that the base 54 is slidably received within the slot 60. A force may be applied to the housing 20 of the rear-sight assembly 12 in a direction substantially perpendicular to a longitudinal axis of the firearm 16 to position the housing 20 and, thus, the rear-sight assembly 12 relative to the firearm 16 within the slot 60. Once a desired position of the housing 20 is achieved, a set screw or other fastener 62 (FIG. 1) may be received within a threaded aperture 64 formed through the housing 20 (FIG. 3) to secure the housing 20 relative to the slot 60. Sufficient rotation of the fastener 62 relative to the housing 20 within the threaded aperture 64 causes a distal end (not shown) of the fastener 62 to engage the firearm 16 within the slot 60 to restrict movement of the housing 20 in a direction substantially perpendicular to the longitudinal axis of the firearm 16 once a desired position of the housing 20 relative to the firearm 16 is achieved. Should removal of the housing 20 from the firearm 16 be desired, the fastener 62 may be rotated relative to the housing 20 in an opposite direction to disengage the distal end of the fastener 62 from the firearm 16. Disengaging the distal end of the fastener 62 from the firearm 16 once again permits movement of the housing 20 relative to the firearm 16 in a direction substantially perpendicular to the longitudinal axis of the firearm 16. As described above, such movement of the housing 20 relative to the firearm 16 allows removal of the rear-sight assembly 12 from the firearm 16.

With particular reference to FIG. 2, the rear-sight assembly 12 may include an illumination device 22. The illumination device 22 may include a pair of tritium lamps 66 that provide the rear-sight assembly 12 with a pair of rear-aiming points 68 (FIG. 4). Each tritium lamp 66 may be received within a respective bore 34 of a respective projection 26 during manufacturing of the rear-sight assembly 12 and may be retained therein by a suitable adhesive. Each tritium lamp 66 may include an outer tube 70, an inner tube 72, a gaseous tritium source 74, a sapphire lens 76, and a plug 77 that seals the outer tube 70. The outer tube 70 may be formed from Aluminum and may support the inner tube 72. The inner tube 72 may be formed from glass and may contain the gaseous tritium source 74. The plug 77 may be formed from any suitable sealant such as, for example, silicone, to seal the outer tube 72.

While the outer tube 70 is described as being formed from Aluminum and the inner tube 72 as being formed from glass, any suitable material could be used when forming the outer tube 70 and the inner tube 72. Furthermore, while the illumination device 22 is described and shown as including an outer tube 70, the outer tube 70 may or may not be utilized. If the illumination device 22 does not include an outer tube 70, the inner tube 72 may be directly received by the respective bores 34 of the projections 26.

An area generally surrounding the rear-aiming points 68 may include a similar—if not identical—color to that of the surface 44 of the housing 20 to provide the rear-sight assembly 12 with a surface that opposes a shooter with a substantially uniform appearance. In one configuration, the color applied is black and is achieved by applying a black paint to the area surrounding the rear-aiming points 68. The black paint causes the illuminated rear-aiming points 68 to be subdued to prevent the rear-aiming points from distracting the shooter during use in daylight or in well-lit areas and to accentuate the front-sight assembly 14. While the black paint is described as being directly applied to an area surrounding the rear-aiming points 68, the black outline could alternatively be implemented as a pair of collars 78 that surround respective rear-aiming points 68. Further, while a black paint is described, any paint and/or material that reduces the glare of the opening and causes the rear-aiming points 68 to be subdued could be implemented.

With continued reference to FIGS. 2 and 3, the front-sight assembly 14 is provided and may include a housing 80 and an illumination device 82. The housing 80 may include a bore 84 at least partially formed therethrough and an attachment feature 86. The bore 84 may be at least partially formed through the housing 80 and may include an enlarged opening 88 and a cross bore 89(FIG. 3). The attachment feature 86 may extend generally away from the housing 80 and may include a cross bore 89 and base 90 connected to the housing 80 via a pair of tapered surfaces 92. As with the rear-sight assembly 12, the base 90 includes an increasing width as the base 90 extends away from the housing 80 due to the tapered surfaces 92. Therefore, the widened base 90, in conjunction with the tapered surfaces 92, helps retain the housing 80 and, thus, the front-sight assembly 14, within a slot 94 formed in the firearm 16.

In one configuration, the base 90 includes the same—if not identical—shape as the slot 94 formed in the firearm 16. Therefore, when the housing 80 is positioned relative to the firearm 16 such that the base 90 is slidably received within the slot 94, a force may be applied to the housing 80 in a direction substantially perpendicular to the longitudinal axis of the firearm 16 to position the housing 80 and, thus, the front-sight assembly 14, in a desired position relative to the firearm 16. Depending on the particular firearm 16, the slot 94 may be formed in the slide 19 or top surface 48 of the firearm 16. Therefore, movement of the housing 80 in a direction substantially perpendicular to the longitudinal axis of the firearm 16 positions the housing 80 and, thus, the front-sight assembly 14, relative to the barrel 18. Once the desired position of the front-sight assembly 14 within the slot 94 is achieved, removal of the front-sight assembly 14 from the firearm 16 is restricted due to the shape of the base 90 and its mating relationship with the slot 94.

As described above and shown in FIGS. 1-4, the attachment feature 28 of the rear-sight assembly 12 and the attachment feature 86 of the front-sight assembly 14 include a configuration that matingly engages slots 60 and 94, respectively, of the firearm 16 to selectively attach the rear-sight assembly 12 and the front-sight assembly 14 to the firearm 16. The overall shape and configuration of the attachment features 28, 86—as shown in FIGS. 1-4—are configured to accommodate a Smith & Wesson Military and Police handgun to allow the attachment features 28, 86 to be matingly received within slots 60, 94 that are specific to a Smith & Wesson Military and Police handgun. While the sighting system 10 is described as including a rear-sight assembly 12 and a front-sight assembly 14 respectively including attachment features 28, 86 designed and configured to matingly engage slots 60, 94 of a Smith & Wesson Military and Police handgun 16, the sighting system 10 could be used in conjunction with any firearm that accommodates the attachment features 28, 86 of the rear-sight assembly 12 and front-sight assembly 14.

The illumination device 82 may include a single tritium lamp 66. The tritium lamp 66 may include the same—if not identical—construction as the tritium lamps 66 associated with the rear-sight assembly 12. Because the tritium lamp 66 associated with the front-sight assembly 14 is similar if not identical to the tritium lamps 66 of the rear-sight assembly 12, a detailed description of the tritium lamp 66 associated with the front-sight assembly 14 is foregone.

During manufacturing, the illumination device 82 may be slidably received within the bore 84 of the housing 80 and may be secured therein via a suitable adhesive in a similar fashion as the illumination devices 22 associated with the rear-sight assembly 12. The cross bore 89 of the housing 80 permits air disposed within the housing 80 to escape via the cross bore 89 when displaced by installation of the illumination device 82.

A brightly colored material may be applied directly within the enlarged opening 88 of the housing 80 and, once cured, may include a concave surface 98. The brightly colored material may include any color including, but not limited to, yellow, pink, orange, green, and/or white. The brightly colored material may include a fluorescent and/or photoluminescent material and, in one configuration, may be a paint applied directly within the enlarged opening 88.

While the front-sight assembly 14 is described as including a brightly colored material applied directly to the enlarged opening 88 of the housing 80, the brightly colored material may be a collar 96. The collar 96 may be received within the enlarged opening 88 proximate to the bore 84 to generally surround the illumination device 82. As described above, the brightly colored material of the collar 96 may include any color including, but not limited to, yellow, pink, orange, green, and/or white. The brightly colored material may likewise include a fluorescent and/or photoluminescent material.

Regardless of the particular color and composition, the brightly colored material helps to illuminate the area of the illumination device 82 to aid a shooter in aligning the U-shaped opening 42 of the rear-sight assembly 12 with the front-sight assembly 14. The brightly colored material, in conjunction with the illumination device 82, provides the front-sight assembly 14 with an illuminated front-aiming point 100 (FIG. 4).

In addition to the brightly colored material, the area of the front-aiming point 100 may include a top coat (not shown) such as a clear coating disposed over the concave surface 98 that covers the brightly colored material to protect the brightly colored material from becoming damaged. Once cured, the top coat may at least partially fill the concave surface 98 and, in one configuration, may be an epoxy. Regardless of the particular material of the top coat, the top coat may provide the front-sight assembly 14 with a substantially planar front surface 102, or may generally follow the concave surface 98.

As shown in FIG. 3, the front surface 102—regardless of the top coat—may be formed at an angle (θ) relative to the top surface 48 of the firearm 16 such that a top 104 of the front surface 102 is disposed a greater distance away from the rear-sight assembly 12 than is a bottom 106 of the front surface 102. Positioning the front surface 102 of the housing 80 at an angle (θ) relative to the firearm 16 exposes the brightly colored material surrounding the illumination device 82 and enhances the ability of the brightly colored material in reflecting light. Allowing the brightly colored material to reflect light accentuates the area surrounding the illumination device 82 to allow a shooter to quickly and easily identify the illuminated front-aiming point 100 of the front-sight assembly 14.

Providing for quick and easy identification of the illuminated aiming point 100 of the front-sight assembly 14 reduces the time required to properly align the illuminated aiming point 100 with the rear-aiming point 68 of the rear-sight assembly 12 when shooting in dark or dimly lit conditions. Likewise, providing for quick and easy identification of the illuminated aiming point 100 of the front-sight assembly 14 reduces the time required to properly align the illuminated aiming point 100 within the U-shaped opening 42 of the rear-sight assembly 12 when shooting in daylight or brightly lit conditions.

As described above, the U-shaped opening 42 is larger than the front-sight assembly 14 to permit the front-sight assembly 14 to be fully viewed when looking through the U-shaped opening 42. Therefore, the entirety of the brightly colored material—as well as the entire housing 80—may be seen by a shooter when looking through the U-shaped opening 42 of the rear-sight assembly 12. Providing sufficient clearance for the brightly colored material and housing 80 of the front-sight assembly 14 further enhances the ability of the shooter to quickly and accurately alight the front-aiming point 100 with the rear-sight assembly 12.

With particular reference to FIGS. 1 and 4, operation of the sighting system 10 will be described in detail. Once the rear-sight assembly 12 and front-sight assembly 14 are installed on the firearm 16, the rear-sight assembly 12 and the front-sight assembly 14 may be used to properly align the barrel 18 of the firearm 16 relative to a target. Specifically, the front-sight assembly 14 may first be aligned with a target such that the illuminated front-aiming point 100 is positioned on a target. The firearm 16 may then be moved until the rear-aiming points 68 are aligned with the illuminated front-aiming point 100 if shooting in dark conditions or until the top 50 of the rear-sight assembly 12 is aligned with the top 104 of the housing 80 if shooting in well-lit conditions, as shown in FIG. 4 to account for elevation and/or windage. Properly aligning the front-sight assembly 14 with the rear-sight assembly 12 aides a shooter in properly aligning the barrel 18 of the firearm 16 relative to a target and, therefore, increases the likelihood that a projectile shot from the firearm 16 will impact a target at a desired location.

Figure 5:
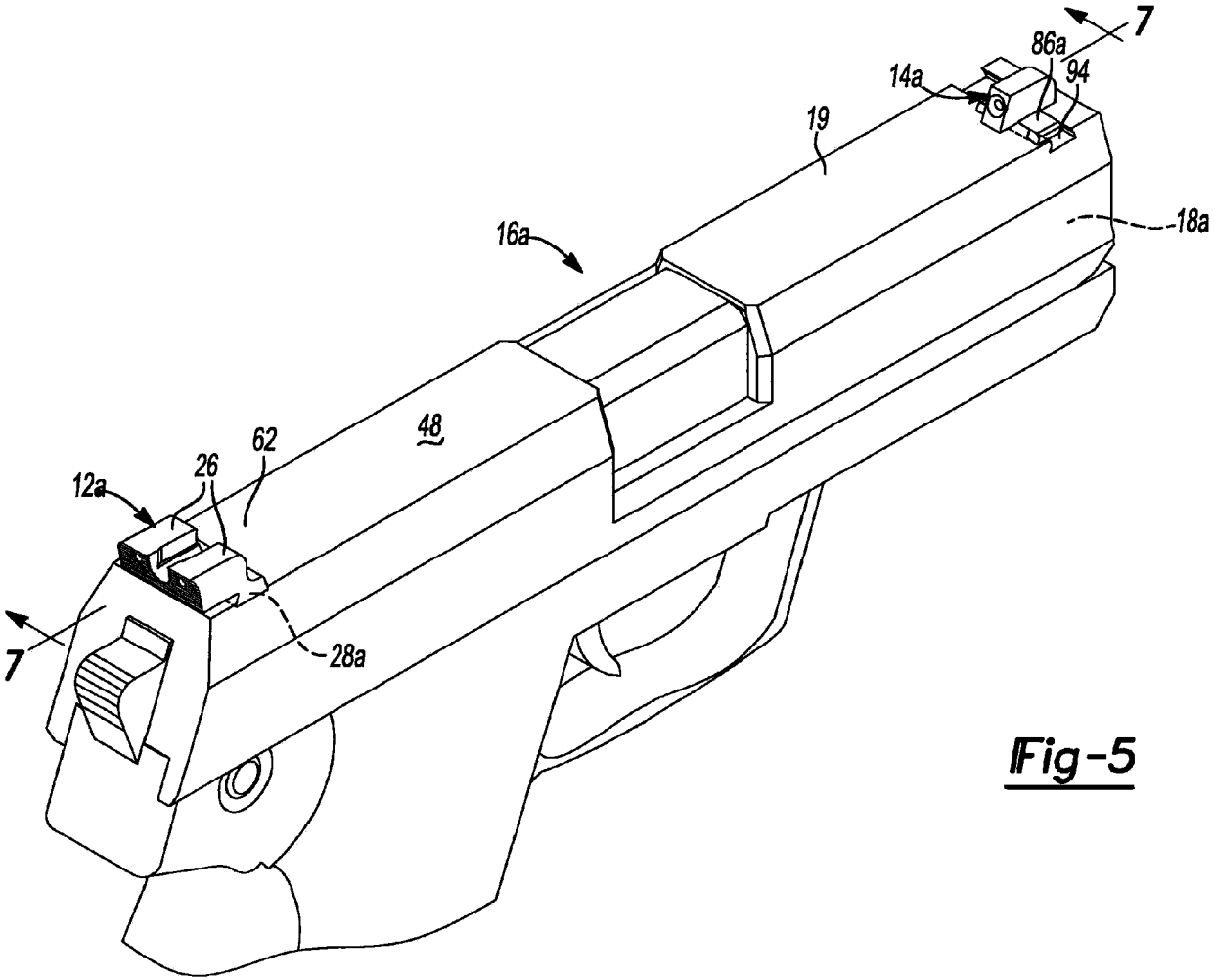
FIG. 5 is a perspective view of a firearm incorporating a sighting system in accordance with the principles of the present disclosure.
Figure 6:
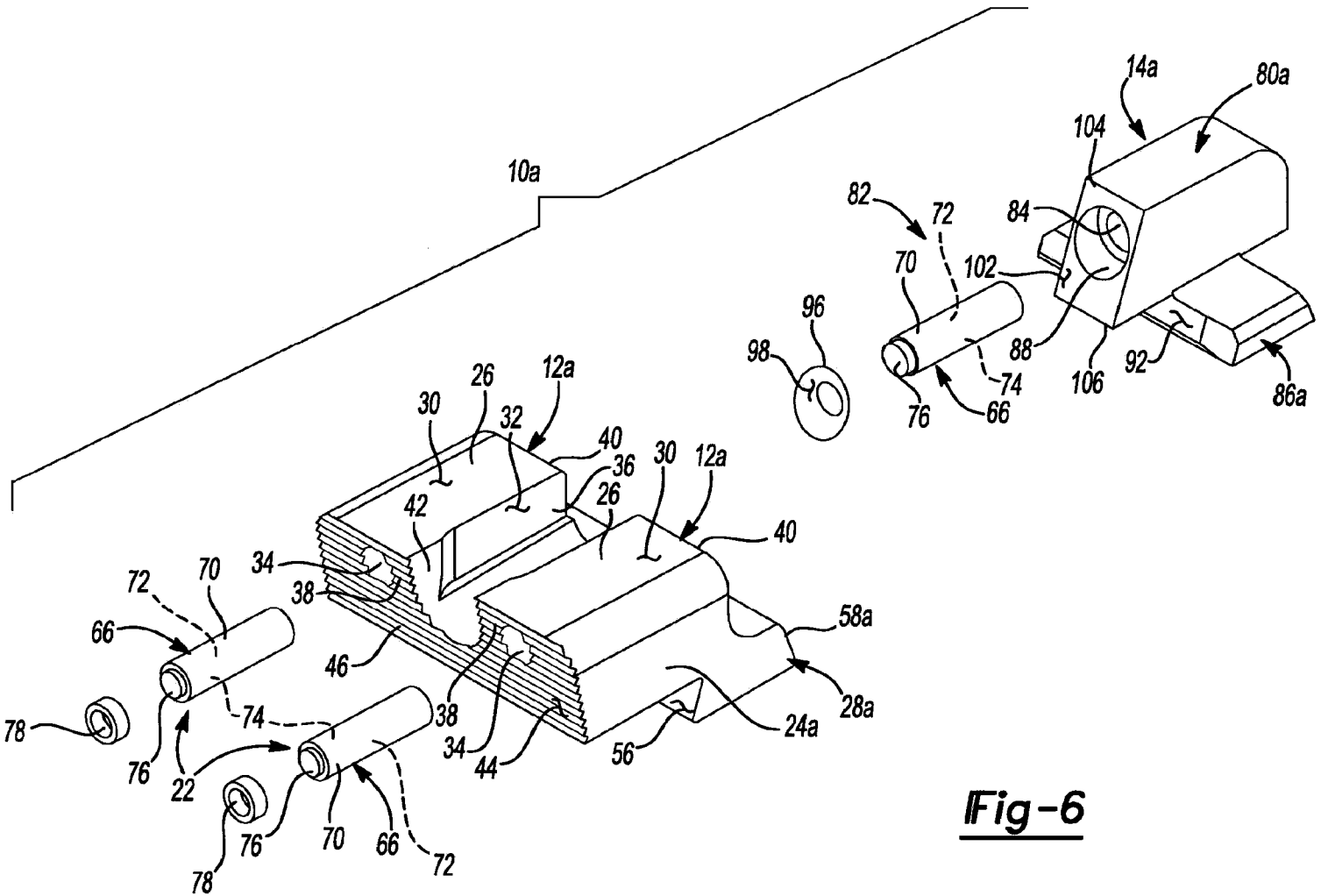
FIG. 6 is an exploded view of the sighting system of FIG. 5.
Figure 7:
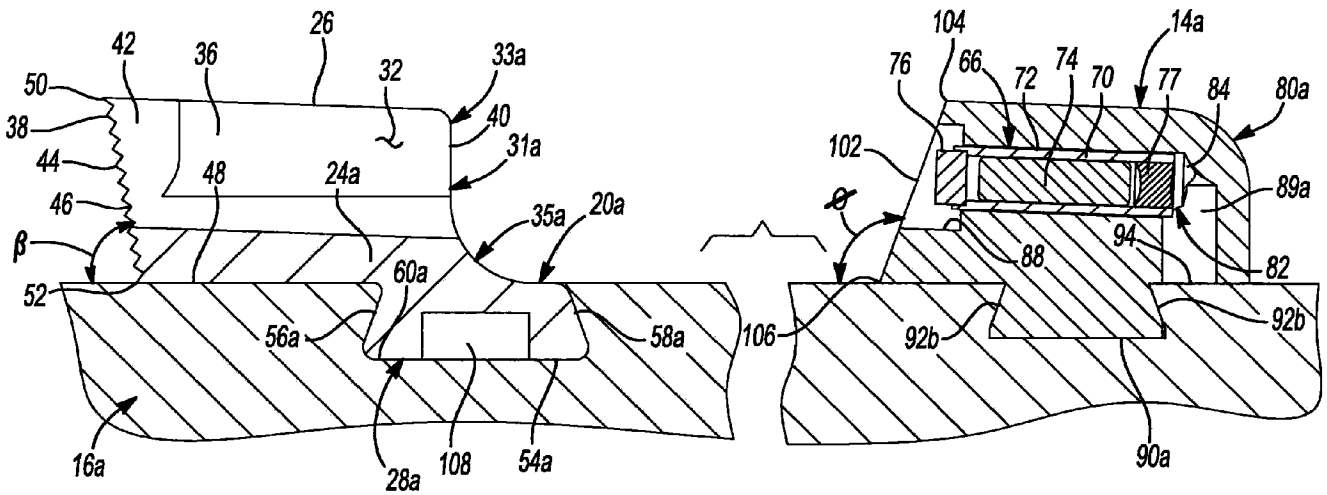
FIG. 7 is a cross-sectional view of the sighting system of FIG. 5 taken along lines 7-7 of FIG. 5.
Figure 8:
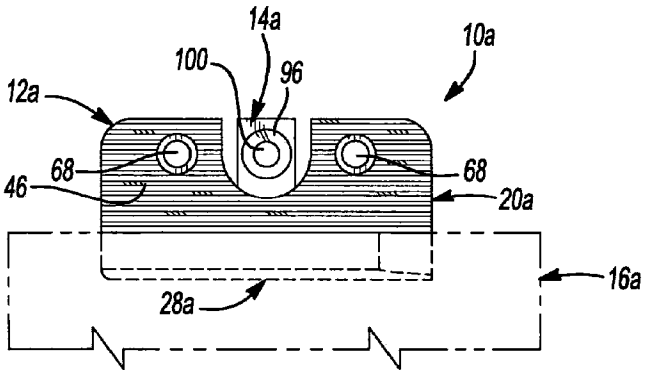
FIG. 8 is a front view of the sighting system of FIG. 5 showing alignment between a rear-sight assembly and a front-sight assembly.

With particular reference to FIGS. 5-7, a sighting system 10*a* is provided and may include a rear-sight assembly 12*a* and a front-sight assembly 14*a*. In view of the substantial similarity in structure and function of the components associated with the sighting system 10 with respect to the sighting system 10*a*, like reference numerals are used hereinafter and in the drawings to identify like components while like reference numerals containing letter extensions are used to identify those components that have been modified.

The sighting system 10*a* includes a pair of rear-aiming points 68 and a front-aiming point 100 that cooperate to facilitate alignment of the barrel 18*a* of the firearm 16*a* relative to a target in a similar fashion as the sighting system 10. However, the sighting system 10*a* includes an attachment feature 28*a* extending from the main body 24*a* of housing 20*a* that accommodates installation of the sighting system 10*a* on a Springfield XD handgun rather than on a Smith and Wesson handgun. While the attachment feature 28*a* is configured for installation on a Springfield XD handgun, the sighting system 10*a* could be used in conjunction with any firearm that accommodates the attachment feature 28*a*. Specifically, the attachment feature 28*a* allows the rear-sight assembly 12*a* to be properly installed in a slot 60*a* of the Springfield XD handgun 16*a* and includes a recess 108*a* and a base 54*a* (including surfaces 56*a*, 58*a*) having a different configuration than the attachment feature 28. As with the housing 20, the housing 20*a* may also include a substantially rear vertical surface 31*a* flanked by rounded or radiused surfaces 33*a* and 35*a*.

The front-sight assembly 14*a* includes a somewhat different configuration when compared to the front-sight assembly 14, as the cross bore 89*a* is shifted relative to the base 90*a*. Further, the attachment feature 86*a* is somewhat different than the attachment feature 86 of the rear-sight assembly 12, as the cross bore 89*a* does not extend completely through the base 90*a*.

While the attachment features 28*a*, 86*a* include a different shape and configuration than the attachment features 28, 86 of the rear-sight assembly 12 and the front-sight assembly 14, respectively, the attachment features 28*a*, 86*a* are similarly slidably received within respective slots 60*a*, 90 of the firearm 16*a*. As such, each of the rear-sight assembly 12*a* and the front-sight assembly 14*a* may be adjusted in a direction substantially perpendicular to a longitudinal axis of the firearm 16*a* to properly position the rear-sight assembly 12*a* and the front-sight assembly 14*a* relative to the firearm 16*a*. Once properly positioned, the attachment features 28*a*, 86*a* cooperate with the respective slots 60*a*, 94 and, due to the shape of the bases 54*a*, 90*a*, are restricted from being inadvertently removed from the firearm 16*a*. Once assembled to the firearm 16*a*, the front-sight assembly 14*a* cooperates with the rear-sight assembly 12*a* to aid a shooter in aligning the barrel 18*a* of the firearm 16*a* relative to a target in a similar fashion, as described above with respect to the sighting system 10.

Figure 9:
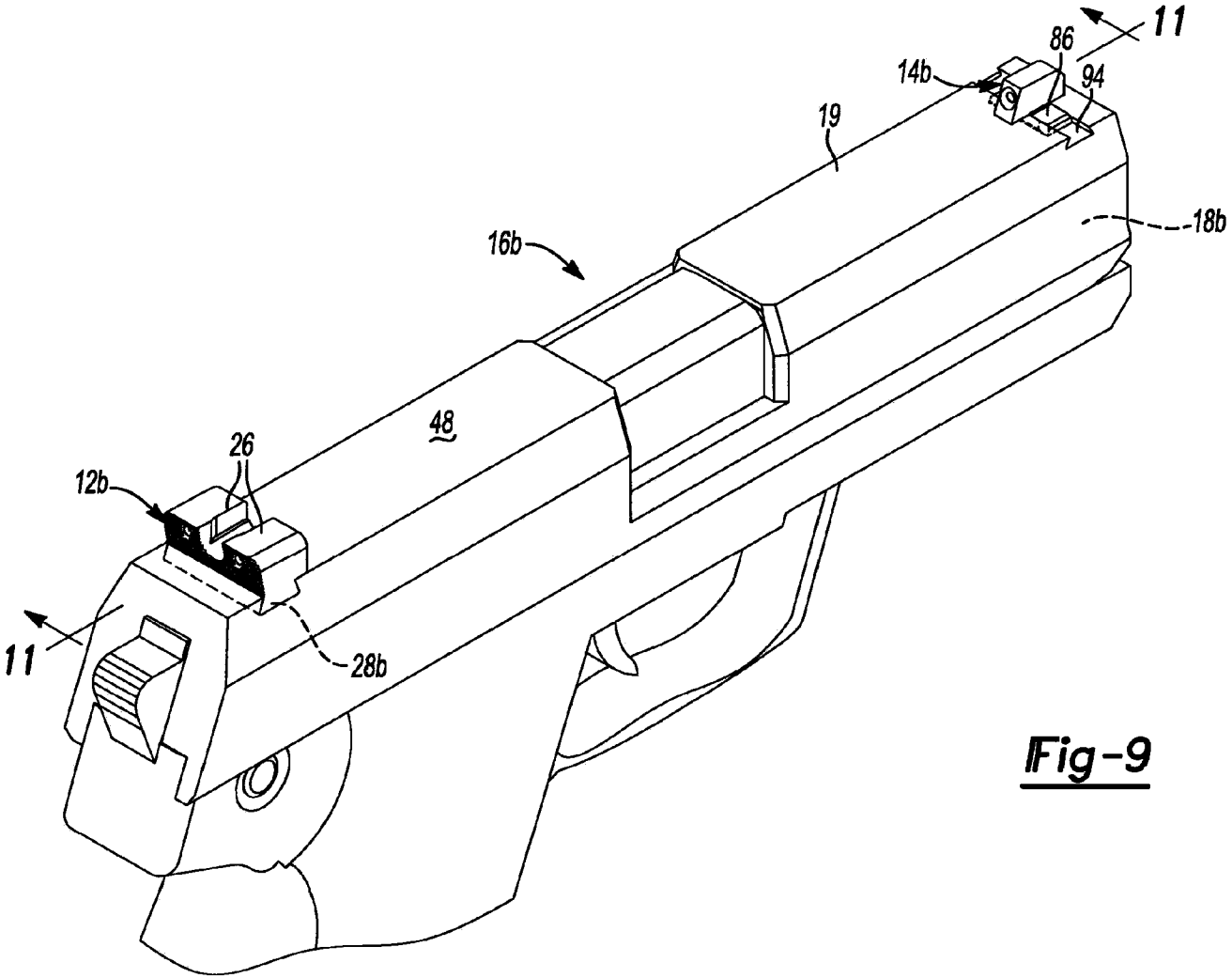
FIG. 9 is a perspective view of the firearm incorporating a sighting system in accordance with the principles of the present disclosure.
Figure 10:
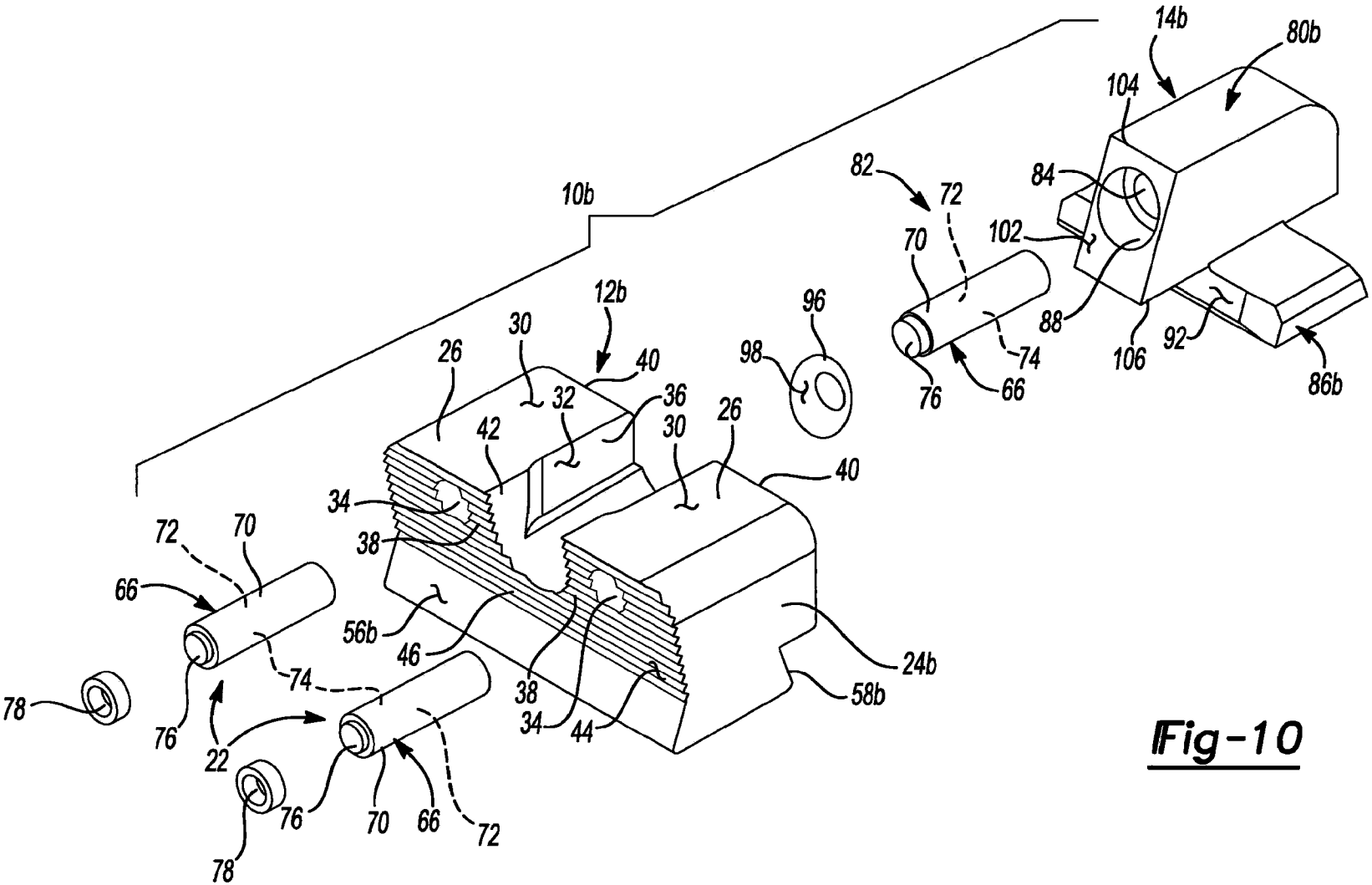
FIG. 10 is an exploded view of the sighting system of FIG. 9.
Figure 11:
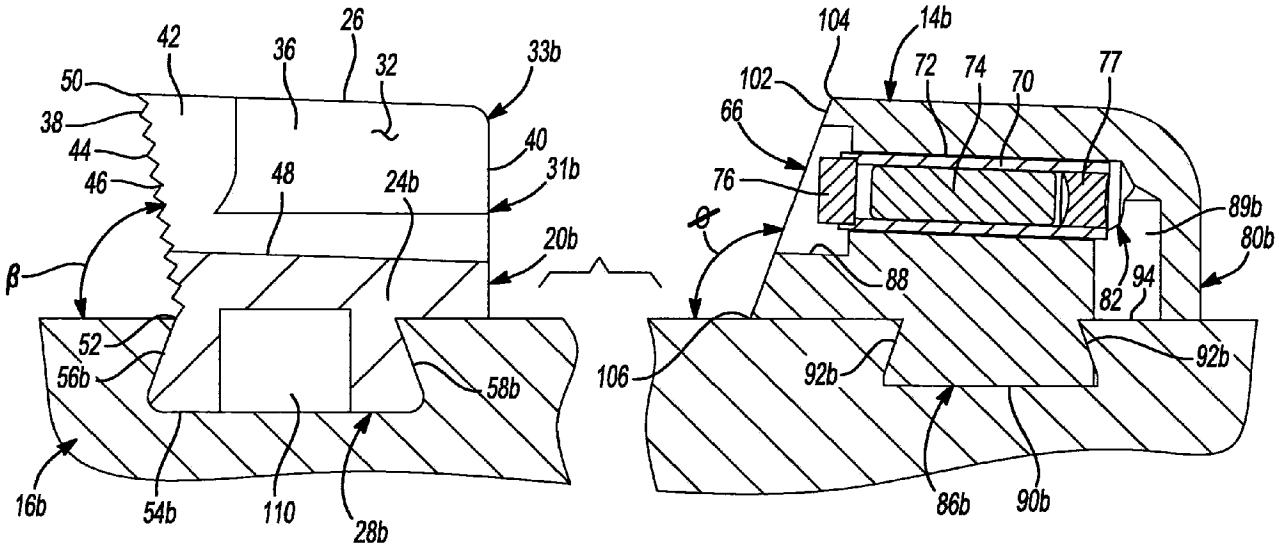
FIG. 11 is a cross-sectional view of the sighting system of FIG. 9 taken along lines 11-11 of FIG. 9.
Figure 12:
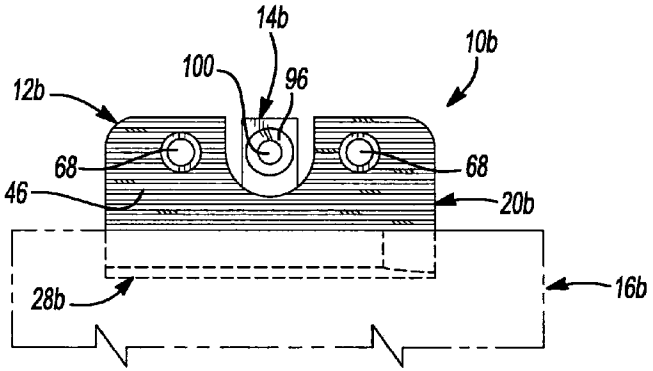
FIG. 12 is a front view of the sighting system of FIG. 9 showing alignment between a rear-sight assembly and a front-sight assembly.
Figure 13:
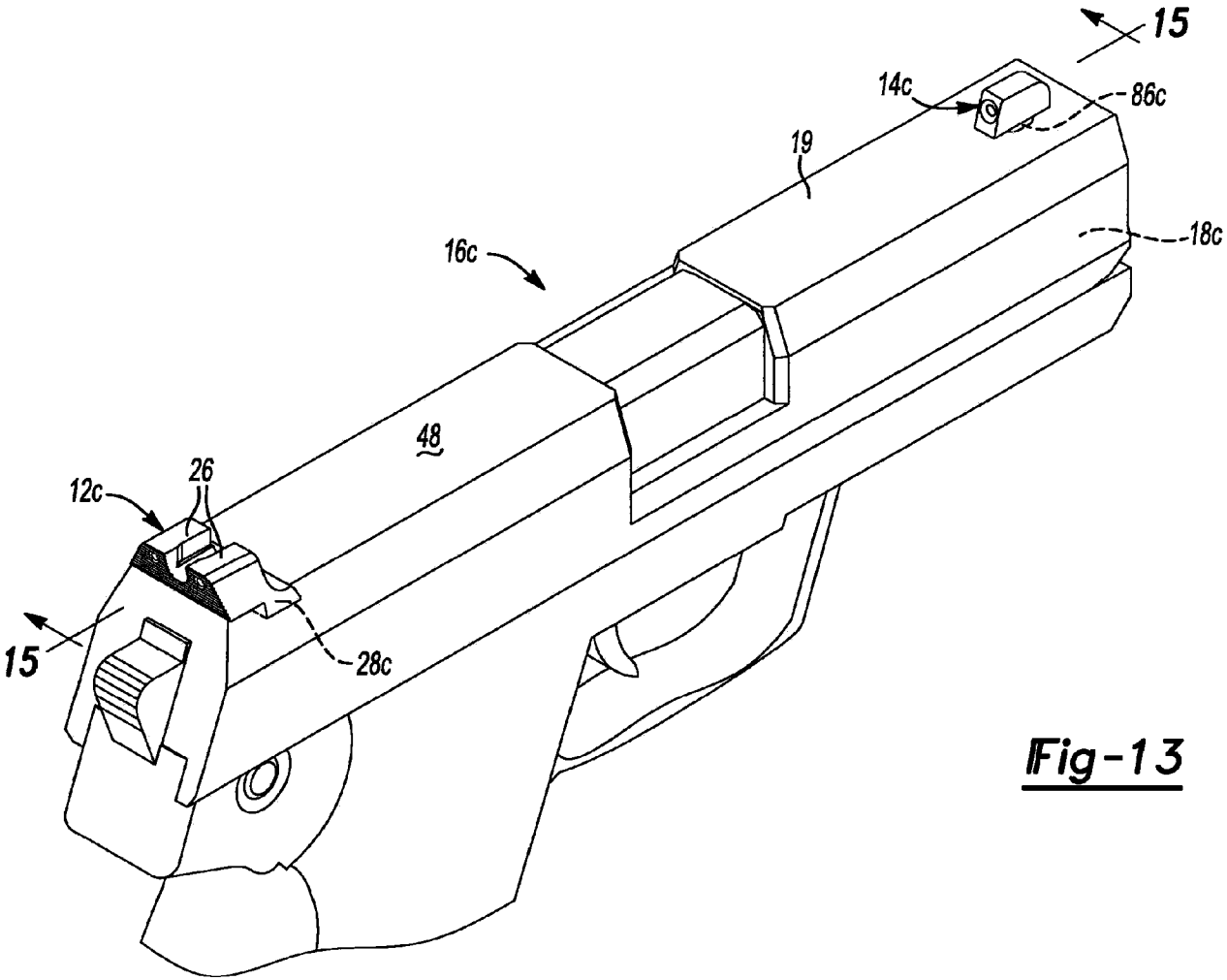
FIG. 13 is a perspective view of a firearm incorporating a sighting system in accordance with the principles of the present disclosure.
Figure 14:
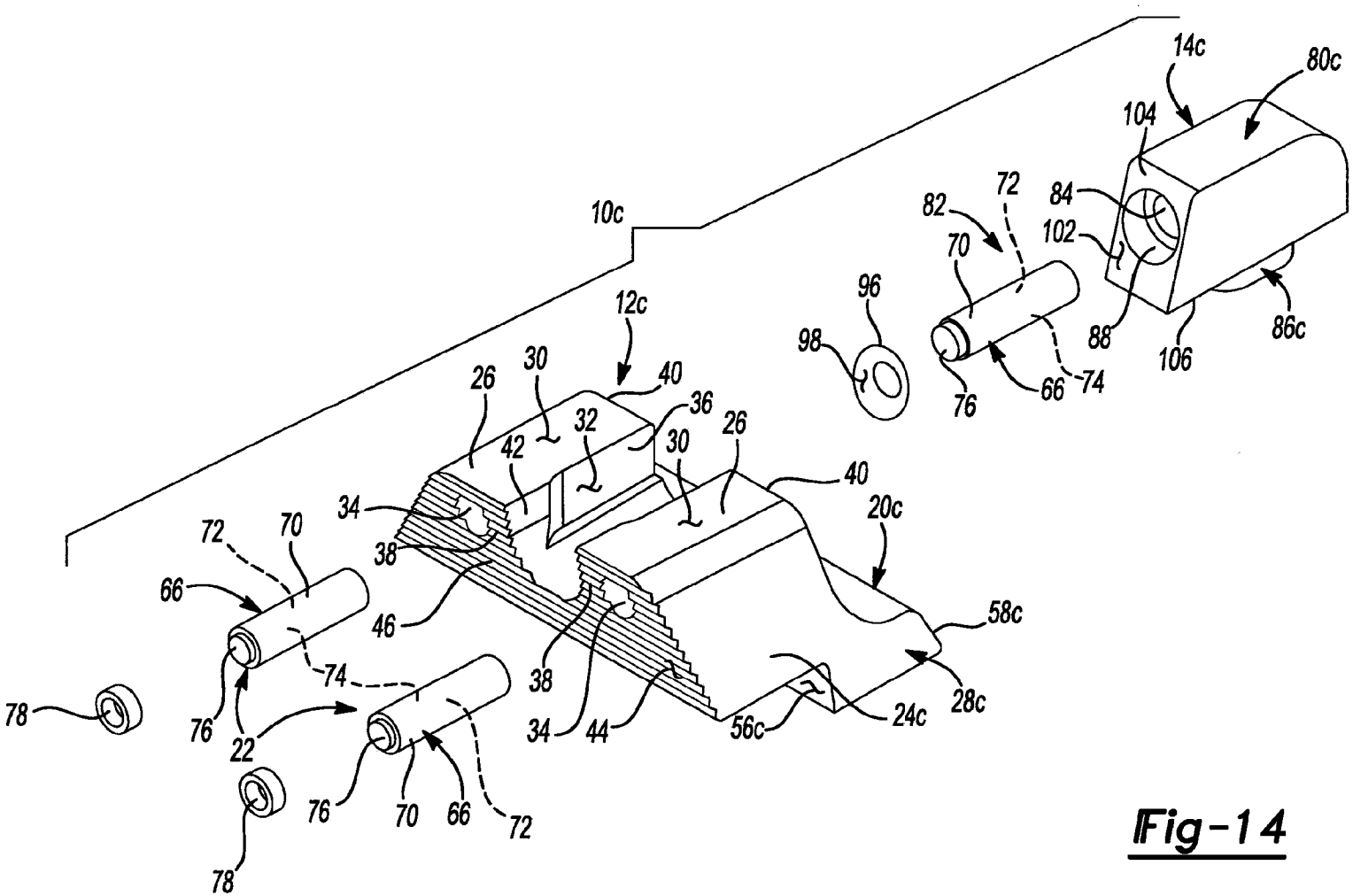
FIG. 14 is an exploded view of the sighting system of FIG. 13.
Figure 15:
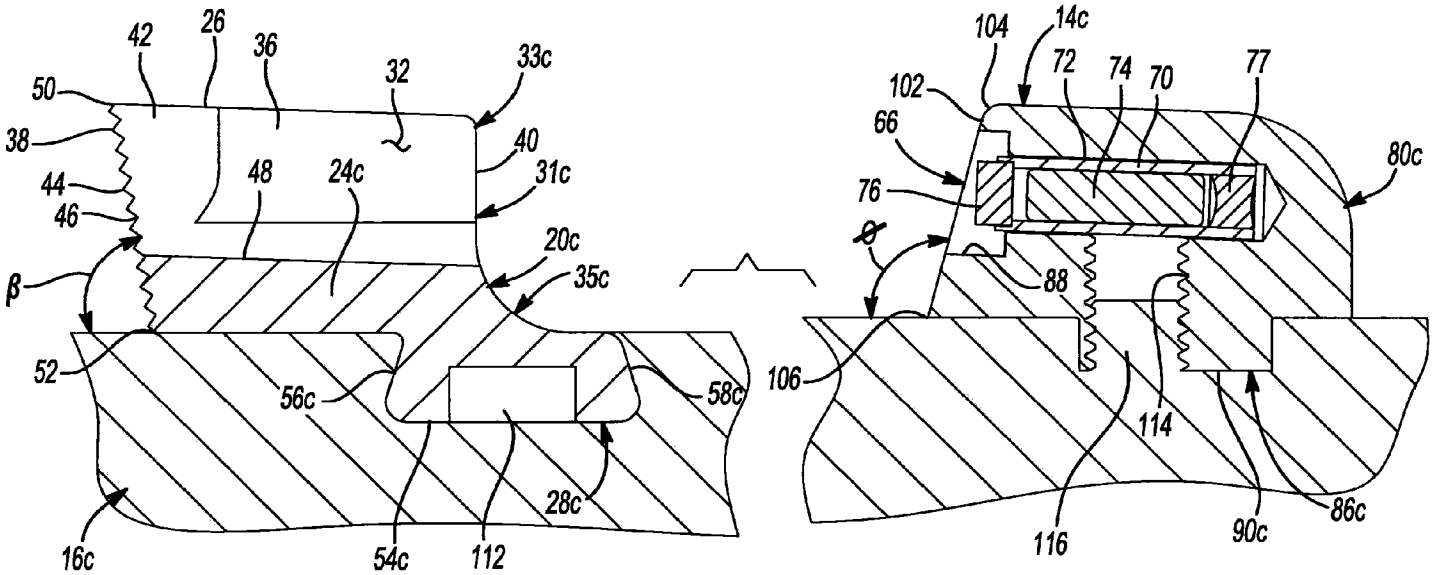
FIG. 15 is a cross-sectional view of the sighting system of FIG. 13 taken along lines 15-15 of FIG. 13.
Figure 16:
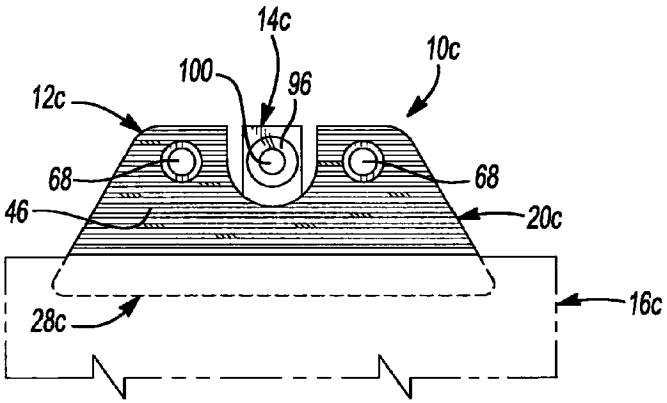
FIG. 16 is a front view of the sighting system of FIG. 13 showing the relationship between a rear-sight assembly and a front-sight assembly.

With particular reference to FIGS. 9-11, a sighting system 10*b* is provided and may include a rear-sight assembly 12*a* and a front-sight assembly 14*b*. In view of the substantial similarity in structure and function of the components associated with the sighting system 10 with respect to the sighting system 10*b*, like reference numerals are used hereinafter and in the drawings to identify like components while like reference numerals containing letter extensions are used to identify those components that have been modified.

The sighting system 10*b* includes a rear-sight assembly 12*b* and a front-sight assembly 14*b* that respectively include a housing 20*b*, 80*b* having an attachment feature 28*b*, 86*b* configured to matingly engage a respective slot 60*b*, 94 of a Sig Sauer firearm 16*b* while the attachment feature 28*b* is designed for use with a Sig Sauer firearm, the sighting system 10*b* could be used in conjunction with any firearm that accommodates the attachment feature 28*b*. As with the sighting system 10, the attachment feature 28*b* extends from a main body 24*b* and includes a base 54*b* having a pair of tapered surfaces 56*b*, 58*b* slidably received within the slot 60*b* of the firearm 16*b* and the front-sight assembly 14*b* includes a base 90*b* having a pair of tapered surfaces 92*b* slidably received within a slot 94 of the firearm 16*b*.

A force may be applied to the rear-sight assembly 12 to move the rear-sight assembly 12*a* in a direction substantially perpendicular to a longitudinal axis of the firearm 16*b* to properly position the rear-sight assembly 12*b* relative to the firearm 16*b*. A force may also be applied to the front-sight assembly 14*b* in a direction substantially perpendicular to a longitudinal axis of the firearm 16*b* to position the front-sight assembly 14*b* relative to the firearm 16*b*. Once the rear-sight assembly 12*b* and the front-sight assembly 14*b* are properly positioned relative to the firearm 16*b*, interaction between the base 54*b* and the slot 60*b* of the firearm 16*b* and between the base 90*b* and the slot 94 of the firearm 16*b* restricts inadvertent removal of the rear-sight assembly 12*b* and the front-sight assembly 14*b* from the firearm 16*b*.

While the base 54*b* is similar to the base 54 of the sighting system 10, the base 54*b* may include a recess 110 disposed proximate to a center of the base 54*b*. The recess 110 reduces the overall weight of the rear-sight assembly 12*a* and may aid in positioning the rear-sight assembly 12*b* relative to the firearm 16*b*. Further, the front-sight assembly 14*b* may include a cross bore 89*b* (FIG. 11) that is shifted relative to the cross bore 89 of the front-sight assembly 14.

Upon installation of the rear-sight assembly 12*b* and front-sight assembly 14*b* on the firearm 16*b*, the rear-sight assembly 12*b* and the front-sight assembly 14*b* may be used by a shooter to facilitate alignment of the barrel 18*b* of the firearm 16*b* in a similar fashion, as described above with respect to the sighting system 10.

With particular reference to FIGS. 13-16, a sighting system 10*c* is provided and may include a rear-sight assembly 12*c* and a front-sight assembly 14*c*. In view of the substantial similarity in structure and function of the components associated with the sighting system 10 with respect to the sighting system 10*c*, like reference numerals are used hereinafter and in the drawings to identify like components while like reference numerals containing letter extensions are used to identify those components that have been modified.

The rear-sight assembly 12*c* may include a housing 20*c* having an attachment feature 28*c* that is matingly received within a slot 60*c* of the firearm 16*c*. The attachment feature 28*c* may include a recess 112 formed in a base 54*c* that reduces the overall weight of the rear-sight assembly 12*c* and may serve to facilitate prompt alignment of the rear-sight assembly 12*c* relative to the firearm 16*c*. As with the housing 20, the housing 20*c* may also include a substantially rear vertical surface 31*c* flanked by rounded or radiused surfaces 33*c* and 35*c*.

The front-sight assembly 14*c* may likewise include an attachment feature 86*c* having a threaded bore 114 formed in a housing 80*c* thereof. The threaded bore 114 may matingly engage a threaded post 116 disposed within a slot 94*c* of the firearm 16*c*. The threaded bore 114 may threadably engage the threaded post 116 to secure the housing 80*c* of the front-sight assembly 14*c* to the firearm 16*c* to prevent inadvertent removal of the front-sight assembly 14*c* from the firearm 16*c*. The attachment features 28*c*, 86*c* may be configured to allow the rear-sight assembly 12*c* and front-sight assembly 14*c* to be properly installed on a Glock firearm 16*c*. While the attachment feature 28*c* is designed for use with a Glock firearm, the sighting system 10*c* could be used with any firearm that accommodates the attachment feature 28*c*.

Once the rear-sight assembly 12*c* is properly positioned within the slot 60*c* of the firearm 16*c* and the front-sight assembly 14*c* is threadably engaged with the threaded post 116 of the slot 94*c*, the rear-sight assembly 12*c* is properly positioned relative to the front-sight assembly 14*c*. In this configuration, the rear-sight assembly 12*c* and front-sight assembly 14*c* may be used to aid a shooter in properly aligning the barrel 18*c* of the firearm 16*c* relative to a target in a similar fashion, as described above with respect to the sighting system 10.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A sight assembly for a firearm, the sight assembly comprising:

a main body operable to be attached to the firearm;

a pair of projections extending from said main body and defining a first surface facing a direction away from a muzzle of the firearm and a second surface formed on an opposite side of said projections than said first surface and facing a direction toward the muzzle of the firearm, said first surface being formed at an angle relative to a top surface of the firearm such that a bottom portion of said first surface disposed proximate to the top surface of the firearm is closer to the muzzle of the firearm than a top portion of said first surface; and a U-shaped opening disposed between said pair of projections and in communication with a channel defined by said pair of projections, said channel widening along a length of said pair of projections in a direction extending from said first surface to said second surface and extending deeper into said main body in a direction extending from said first surface to said second surface.

2. The sight assembly of claim 1, further comprising a second sight assembly spaced apart and separated from said main body and including a housing having an aiming point, at least one of said housing and said aiming point operable to be aligned with said pair of projections to align the firearm relative to a target.

3. The sight assembly of claim 2, wherein said second sight assembly includes a brightly colored material surrounding said aiming point.

4. The sight assembly of claim 3, further comprising a top coat covering said brightly colored material.

5. The sight assembly of claim 3, wherein said brightly colored material includes at least one of a photoluminescent material and a fluorescent material.

6. The sight assembly of claim 3, wherein said brightly colored material is paint.

7. The sight assembly of claim 3, wherein said brightly colored material provides a concave surface surrounding said aiming point.

8. The sight assembly of claim 2, wherein said aiming point includes an illumination device.

9. The sight assembly of claim 8, wherein said illumination device includes a Tritium lamp.

10. The sight assembly of claim 2, wherein said U-shaped opening is wider than said housing.

11. The sight assembly of claim 1, wherein said first surface includes a series of serrations.

12. The sight assembly of claim 1, wherein said pair of projections each include an aiming point having an illumination device.

13. The sight assembly of claim 12, wherein said illumination device includes a Tritium lamp.

14. The sight assembly of claim 12, further comprising a black material surrounding said aiming points.

15. The sight assembly of claim 14, wherein said black material is a black paint.

16. The sight assembly of claim 1, wherein said second surface is substantially perpendicular to the top surface of the firearm to provide a surface against which a force may be applied to actuate a slide mechanism of the firearm.

* * * * *